US010870290B2

(12) United States Patent
Shibata et al.

(10) Patent No.: US 10,870,290 B2
(45) Date of Patent: Dec. 22, 2020

(54) VAPOR MANAGER

(71) Applicant: Hewlett-Packard Development Company, L.P., Spring, TX (US)

(72) Inventors: Alan Shibata, Vancouver, WA (US); Matthew Raisanen, Vancouver, WA (US); Richard Lee Brinkley, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/326,046

(22) PCT Filed: Sep. 2, 2016

(86) PCT No.: PCT/US2016/050187
§ 371 (c)(1),
(2) Date: Feb. 15, 2019

(87) PCT Pub. No.: WO2018/044321
PCT Pub. Date: Mar. 8, 2018

(65) Prior Publication Data

US 2019/0176490 A1 Jun. 13, 2019

(51) Int. Cl.

| | |
|---|---|
| ***B41J 11/00*** | (2006.01) |
| ***B41J 29/377*** | (2006.01) |
| ***F26B 21/00*** | (2006.01) |
| ***F26B 3/04*** | (2006.01) |
| *F26B 13/18* | (2006.01) |
| *B41J 11/04* | (2006.01) |

(52) U.S. Cl.
CPC ..... *B41J 11/002* (2013.01); *B41J 29/377* (2013.01); *F26B 3/04* (2013.01); *F26B 21/004* (2013.01); *B41J 11/04* (2013.01); *F26B 13/18* (2013.01)

(58) Field of Classification Search
CPC ..... B41J 11/002; B41J 11/04; B41J 29/377; F26B 21/004; F26B 3/04; F26B 13/18
See application file for complete search history.

(56) References Cited

U.S. PATENT DOCUMENTS

| | | | | |
|---|---|---|---|---|
| 4,639,405 | A | 1/1987 | Franke | |
| 5,895,156 | A | 4/1999 | Kabeta et al. | |
| 5,927,203 | A * | 7/1999 | Gieser | B41F 21/00 101/419 |
| 6,272,310 | B1 * | 8/2001 | Blair | G03G 15/2021 219/216 |
| 6,463,674 | B1 | 10/2002 | Meyer | |
| 6,585,259 | B2 * | 7/2003 | Kerpe | B41F 21/00 101/424.1 |

(Continued)

FOREIGN PATENT DOCUMENTS

| | | |
|---|---|---|
| EP | 1300252 | 4/2003 |
| JP | 2001301135 A | 10/2001 |

(Continued)

*Primary Examiner* — Yaovi M Ameh
(74) *Attorney, Agent, or Firm* — Brooks Cameron & Huebsch PLLP

(57) ABSTRACT

In one example, a system for a vapor manager includes a media guide to receive partially dried inkjet media from a heated pressure roller, and a plurality of apertures through the media guide to direct air on to a first portion of the partially dried inkjet media and direct air away from a second portion of the partially dried inkjet media.

13 Claims, 5 Drawing Sheets

(56) References Cited

U.S. PATENT DOCUMENTS

| | | | | |
|---|---|---|---|---|
| 6,889,019 | B2 | 5/2005 | Shin | |
| 7,538,299 | B2 | 5/2009 | Spence et al. | |
| 8,509,646 | B2 | 8/2013 | Shimizu | |
| 8,929,794 | B2 | 1/2015 | Hatazaki | |
| 2005/0093908 | A1 | 5/2005 | Riou et al. | |
| 2012/0141176 | A1* | 6/2012 | Matsushima ..... | G03G 15/6585 399/341 |
| 2014/0161481 | A1* | 6/2014 | Udagawa ..... | G03G 21/206 399/92 |
| 2014/0286665 | A1 | 9/2014 | Minagawa et al. | |
| 2016/0023476 | A1 | 1/2016 | Leighton et al. | |

FOREIGN PATENT DOCUMENTS

| | | |
|---|---|---|
| JP | 2003-237050 | 8/2003 |
| JP | 2013-010245 | 1/2013 |
| JP | 2016-155294 | 1/2016 |
| KR | 100261103 B1 | 7/2000 |

* cited by examiner

VAPOR MANAGER

BACKGROUND

Inkjet printers can deposit quantities of printing fluid onto a printable media (e.g., paper, plastic, etc.). In some examples, inkjet printers can create a curl and/or cockle in the printed media when the printing fluid droplets deposited by the inkjet printer are not completely dry. In some examples, a number of physical properties of the printable media can be changed when the printing fluid droplets deposited by the inkjet printer are not completely dry. For example, the stiffness of the printable media can be changed when the printing fluid droplets deposited by the inkjet printer are not completely dry. The curl, cockle, and/or other physical properties that change due to the printing fluid droplets can make finishing processes difficult.

DETAILED DESCRIPTION

Figure 1:
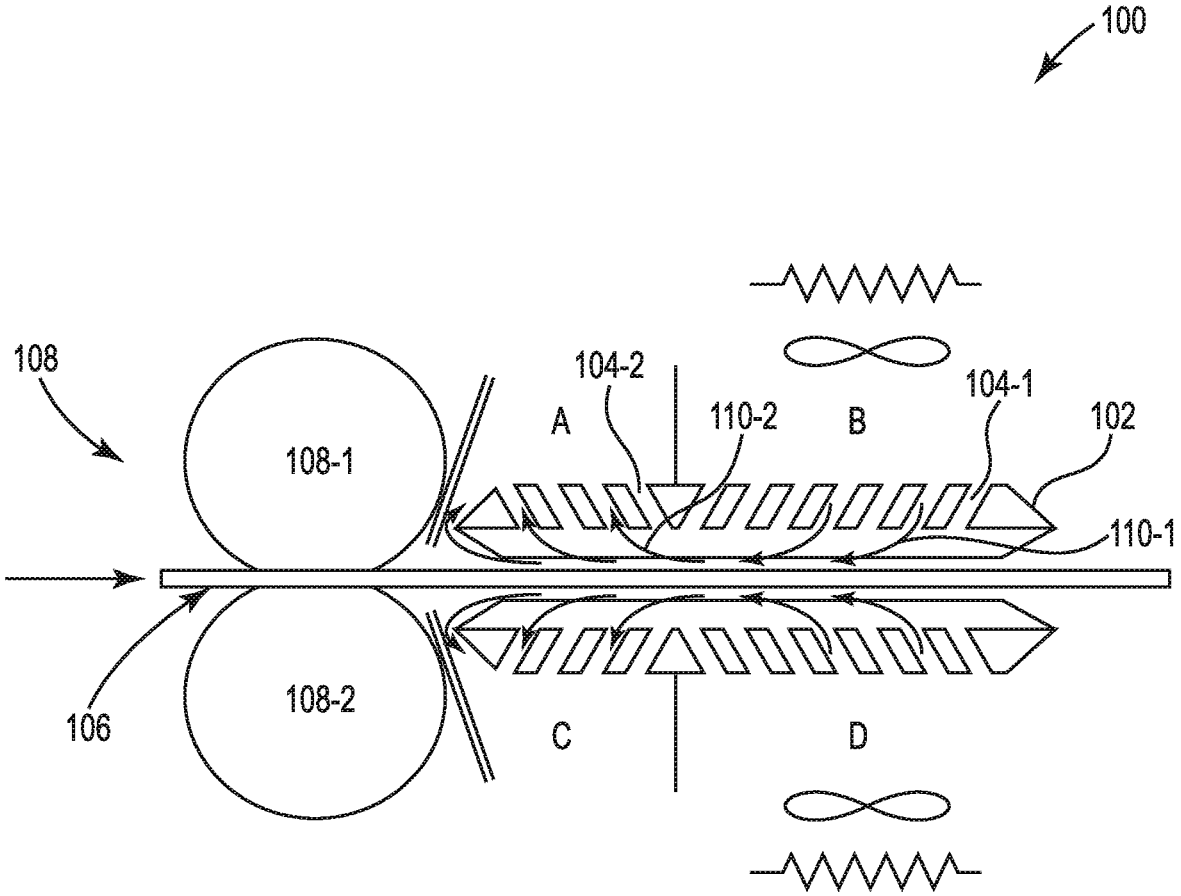
FIG. 1 illustrates an example system for a vapor manager consistent with the present disclosure.

A number of systems and devices for a vapor manager are described herein. In some examples, a system for a vapor manager includes a media guide to receive partially dried inkjet media from a heated pressure roller, and a plurality of apertures through the media guide to direct air on to a first portion of the partially dried inkjet media and direct air away from a second portion of the partially dried inkjet media. As used herein, partially dried inkjet media can include media with applied printing fluid from an inkjet type printing device that is not completely dried on the media.

The partially dried inkjet media can provide difficulties when stacking, aligning, and/or finishing. For example, the partially dried inkjet media can have distorted properties such as a curl, a cockle, a reduction in stiffness, increased surface roughness, extruding fibers from the surface, misaligned fibers, and/or increased sheet to sheet friction of the media. In some examples, these distorted properties can be caused by printing fluid deposited on the media and the media absorbing the printing fluid. For example, the printing fluid can be in a liquid state that can be absorbed by a media such as paper. In this example, the liquid state of the printing fluid can cause the distorted properties of the media in a similar way that other liquids may distort the properties of the media.

The vapor manager as described herein can be coupled to an output of a heated pressure roller. In some examples, the heated pressure roller and vapor manager can be positioned within a print engine of a printing device. As used herein, the print engine of the printing device can include an area that encases a print zone of the printing device. In some examples, the print zone can include an area where printing fluid is deposited on media (e.g., print media, paper, plastic, etc.). In some examples, the heated pressure roller can apply heat and/or pressure to partially dried inkjet media to increase drying and/or evaporation of the printing fluid applied to the partially dried inkjet media. In some examples, the increased evaporation of printing fluid can generate moisture, steam, and/or vapor at an output of the heated pressure roller.

The moisture, steam, and/or vapor generated by the heated pressure roller can cause condensation within the print engine that can cause damage to the printing device and/or damage the partially dried inkjet media. The vapor manager as described herein can be utilized to control the steam and/or moisture. For example, the vapor manager can be utilized to direct air across a media pathway of the partially dried inkjet media at an output of the heated pressure roller. In this example, the directed air can be utilized to remove moisture from the output of the heated pressure roller and/or the print engine. In some examples, the directed air can pass through a plurality of apertures of media guides that receive the partially dried inkjet media at the output of the heated pressure roller. The vapor manager as described herein can remove moisture from the output of heated pressure roller, prevent condensation from occurring as a result of increased evaporation of the printing fluid, and/or accelerate drying of the partially dried inkjet media.

The figures herein follow a numbering convention in which the first digit corresponds to the drawing figure number and the remaining digits identify an element or component in the drawing. Elements shown in the various figures herein may be capable of being added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense.

FIG. 1 illustrates an example system 100 for a vapor manager consistent with the present disclosure. In some examples the system 100 can be utilized to remove moisture, steam, and/or vapor from the system 100. In some examples, the system 100 can include a heated pressure roller 108. In some examples, the heated pressure roller 108 can include a pressure roller and a heated roller. In some examples, the heated pressure roller 108 can receive partially dried inkjet media 106 from a print zone within a print engine of an inkjet printing device.

In some examples, the heated pressure roller 108 can include a first roller 108-1 and a second roller 108-2. In some examples, the first roller 108-1 can be a pressure roller. As used herein, a pressure roller can be utilized to apply pressure to a first side of the partially dried inkjet media 106. In some examples, the first roller 108-1 can utilize a contact zone and a corresponding pressure platen of the second roller 108-2 to apply pressure to the first side of the partially dried inkjet media 106. In some examples, the second roller 108-2 can be a heated roller. In some examples, the heated roller can utilize a heat source and/or a heat transfer belt to apply heat to a second side of the partially dried inkjet media. In some examples, the first roller 108-1 and the second roller 108-2 can work in combination as a heated pressure roller.

In some examples, the heated pressure roller 108 can increase drying of the partially dried inkjet media 106. As described herein, the heated pressure roller 108 can increase evaporation of printing fluid applied to the partially dried inkjet media 106. The increased evaporation can generate moisture, steam, and/or vapor at an output of the heated pressure roller 108, which can damage the system 100. In some examples, the system 100 can include a media guide 102 to receive the partially dried inkjet media 106 from an output of the heated pressure roller 108. In some examples, the media guide 102 can be utilized to manage the moisture, steam, and/or vapor as described herein.

In some examples, the media guide 102 can include a plurality of apertures 104-1, 104-2. In some examples, the plurality of apertures 104-1, 104-2 can be utilized to direct air 110-1 on to the partially dried inkjet media 106 and direct air 110-2 away from the partially dried inkjet media 106. In some examples, the plurality of apertures 104-1, 104-2 can be utilized to direct air through the media guide 102 such that air flows into apertures 104-1 on a first side of the media guide 102 and air flows out apertures 104-2 on a second side of the media guide 102. In some examples, directing air on to the partially dried inkjet media 106 into apertures 104-1 and out of apertures 104-2 can remove moisture, steam, and/or vapor from the output of the heated pressure roller 108 and/or between the media guide 102 and the partially dried inkjet media 106. In some examples, the directed airflow can be reversed such that air is directed into apertures 104-2 and out of apertures 104-1.

The system 100 can be utilized remove moisture from the output of the heated pressure roller 108, prevent condensation from occurring as a result of increased evaporation of the printing fluid on the partially dried inkjet media 106, and/or accelerate drying of the partially dried inkjet media 106. In some examples, the system 100 can remove the moisture, steam, and/or vapor from a print engine to prevent the moisture, steam, and/or vapor from damaging components within the print engine.

Figure 2:
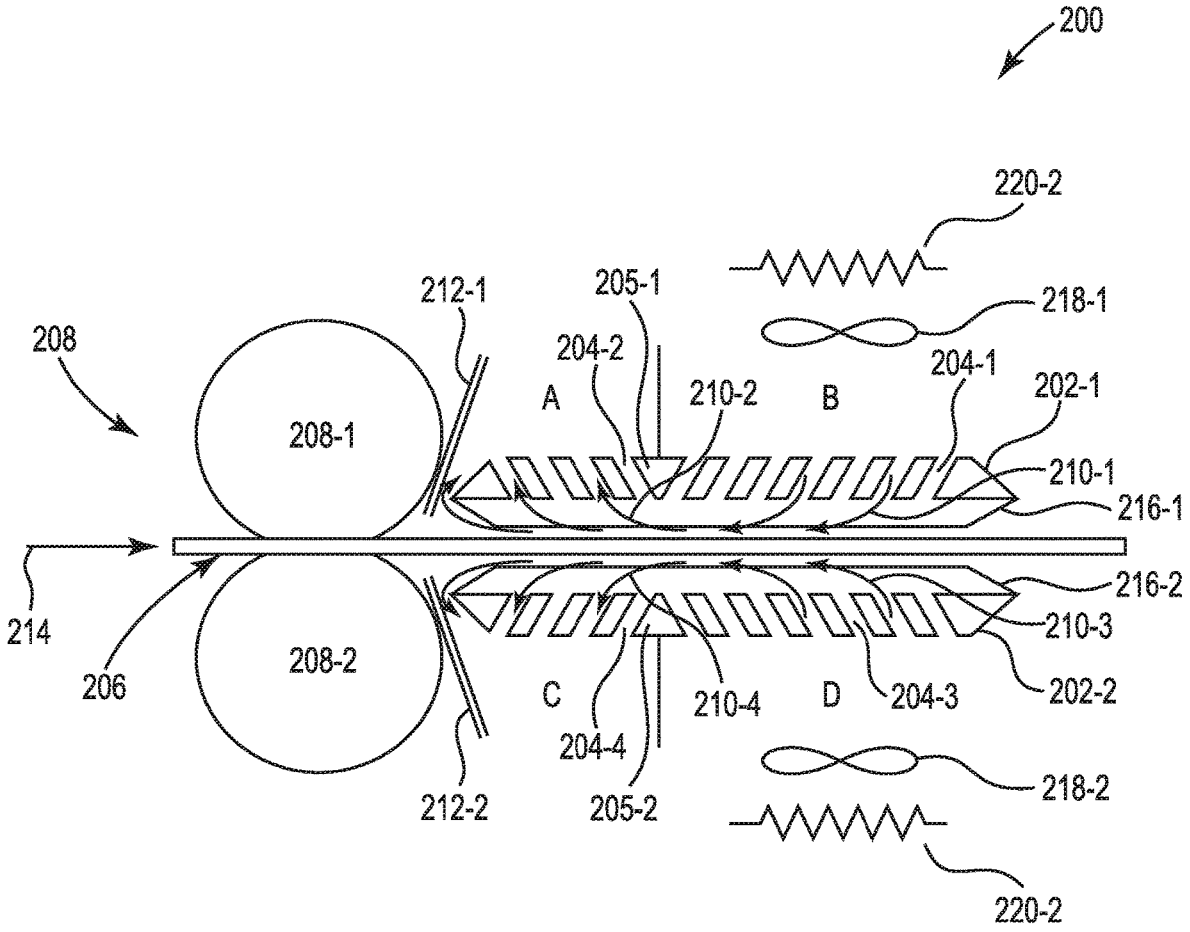
FIG. 2 illustrates an example system for a vapor manager consistent with the present disclosure.

FIG. 2 illustrates an example system 200 for a vapor manager consistent with the present disclosure. In some examples, the system 200 can include similar elements to system 100 as referenced in FIG. 1. For example, system 200 can include a media pathway 214 to provide partially dried inkjet media 206 to a heated pressure roller 208. In some examples, the heated pressure roller 208 can include a pressure roller 208-1 to receive a first side of the partially dried inkjet media 206 and a heated roller 208-2 to receive a second side of the partially dried inkjet media 206. As described herein, the heated pressure roller 208 can increase evaporation of printing fluid applied to the partially dried inkjet media. The increased evaporation can generate moisture, steam, and/or vapor at the output of the heated pressure roller 208, which can potentially damage the system 200.

In some examples, the system 200 can include a first media guide 202-1 to receive the partially dried inkjet media 206 on a first side and a second media guide 202-2 to receive the partially dried inkjet media 206 on a second side. In some examples, the first media guide 202-1 and the second media guide 202-2 can be coupled to an output of the heated pressure roller 208. In some examples, the first media guide 202-1 can be utilized to remove moisture, steam, and/or vapor from the first side of the partially dried inkjet media 206. In some examples, the second media guide 202-2 can be utilized to remove moisture, steam, and/or vapor from the second side of the partially dried inkjet media 206.

In some examples, the first media guide 202-1 can include a plurality of rib structures 216-1 to separate the partially dried inkjet media 206 from the plurality of apertures 204-1, 204-2. For example, the plurality of rib structures 216-1 can prevent the partially dried inkjet material from blocking the plurality of apertures 204-1, 204-2. In some examples, the plurality of rib structures 216-1 can be in contact with the partially dried inkjet media 206 as the partially dried inkjet media 206 passes through the first media guide 202-1 and the second media guide 202-2. In some examples, the second media guide 202-2 can be the same or similar as the first media guide 202-1 positioned on the second side of the partially dried inkjet media 206. For example, the second media guide 202-2 can include a plurality of rib structures 216-2 to prevent the partially dried inkjet media from blocking the plurality of apertures 204-3, 204-4.

In some examples, the first media guide 202-1 can direct air 210-1 on to the partially dried inkjet media 206 and direct air 210-2 away from the partially dried inkjet media 206. In some examples, the plurality of apertures 204-1, 204-2 can be utilized to direct air through the first media guide 202-1 such that air flows into apertures 204-1 on a first side of the first media guide 202-1 and air flows out apertures 204-2 on a second side of the first media guide 202-1. In some examples, directing air on to the partially dried inkjet media 206 into apertures 204-1 and out of apertures 204-2 can remove moisture, steam, and/or vapor from the output of the heated pressure roller 208 and/or between the first media guide 202-1 and the first side of the partially dried inkjet media 206. In some examples, the directed airflow can be reversed such that air is directed into apertures 204-2 and out of apertures 204-1.

Similarly, the second media guide 202-2 can direct air 210-3 on to the partially dried inkjet media 206 and direct air 210-4 away from the partially dried inkjet media 206. In some examples, the plurality of apertures 204-3, 204-4 can be utilized to direct air through the second media guide 202-2 such that air 210-3 flows into apertures 204-3 on a first side of the second media guide 202-2 and air 210-4 flows out apertures 204-4 on a second side of the second media guide 202-2. In some examples, directing air on to the partially dried inkjet media 206 into apertures 204-3 and out of apertures 204-4 can remove moisture, steam, and/or vapor from the output of the heated pressure roller 208 and/or between the second media guide 202-2 and the second side of the partially dried inkjet media 206. In some examples, the directed airflow can be reversed such that air is directed into apertures 204-4 and out of apertures 204-3.

In some examples, the system 200 can include a first fan 218-1 and a second fan 218-2. In some examples, the first fan 218-1 can be positioned within a second quadrant (e.g., quadrant B, etc.) of the system 200. In some examples, the first fan 218-1 can be utilized to direct air 210-1 through the plurality of apertures 204-1 such that air 210-2 is directed out of the plurality of apertures 204-2. That is, the first fan 218-1 can provide air pressure on the first media guide 202-1 that is directed through the plurality of apertures 204-1 in the second quadrant (e.g., quadrant B) and out of the plurality of apertures 104-2 in the first quadrant (e.g., quadrant A). In some examples, the first fan 218-1 can provide a vacuum that can be utilized to direct air through the plurality of apertures 204-2 in the first quadrant (e.g., quadrant A) and out of the plurality of apertures 204-1 in the second quadrant (e.g., quadrant B). In some examples, a fan can be additionally or alternatively positioned in the first quadrant (e.g., quadrant A) and/or a third quadrant (e.g., quadrant C) to direct air through the plurality of apertures 204-1, 204-2, 204-3, 204-4 as described herein.

In some examples, the second fan 218-2 can be positioned within a fourth quadrant (e.g., quadrant D, etc.) of the system 200. In some examples, the second fan 218-2 can be utilized to direct air through the plurality of apertures 204-3 in the fourth quadrant (e.g., quadrant D) such that air is directed out of the plurality of apertures 204-4 in the third quadrant (e.g., quadrant C). That is, the second fan 218-2 can provide air pressure on the second media guide 202-2 that is directed (e.g., forced) through the plurality of apertures 204-3 in the fourth quadrant (e.g., quadrant D) and out of the plurality of apertures 204-4 in the third quadrant (e.g., quadrant C). In some examples, the second fan 218-2 can provide a vacuum that can be utilized to direct air through the plurality of apertures 204-4 in the third quadrant (e.g., quadrant C) and out of the plurality of apertures 204-3 in the fourth quadrant (e.g., quadrant D).

In some examples, the system 200 can include a first heat source 220-1 and/or a second heat source 220-2. In some examples, the first heat source 220-1 can be positioned within an air path 210-1, 210-2 and the second heat source 220-2 can be positioned within an air path 210-3, 210-4. In some examples, the first heat source 220-1 can be coupled to fan 218-1 and/or the second heat source 220-2 can be coupled to fan 218-2. In some examples, the heat source 220-1 and/or the heat source 220-2 can be utilized to provide heated air to the first side and/or the second side of the partially dried inkjet media 206. In some examples, the provided heat can be utilized to increase drying of the partially dried inkjet media 206. In some examples, the provided heat from the first heat source 220-1 and/or the second heat source 220-2 can also prevent condensation from occurring prior to removing the moisture, steam, and/or vapor from the system 200.

In some examples, the system 200 can include a first heat barrier 212-1 on a first side of the partially dried inkjet media 206 and a second heat barrier 212-2 on a second side of the partially dried inkjet media 206. In some examples, the first heat barrier 212-1 can be positioned between the heated pressure roller 208 and the first media guide 202-1. For example, the first heat barrier 212-1 can be positioned between the pressure roller 208-1 and the first media guide 202-1. In some examples, the first heat barrier 212-1 can prevent moisture, steam, and/or vapor from contacting the pressure roller 208-1. In some examples, the first heat barrier 212-1 can be utilized to direct air 210-2 from the second side of the first media guide 202-1 away from the heated pressure roller 208 (e.g., pressure roller 208-1, etc.), such that the moisture, steam, and/or vapor within the air 210-2 is directed away from the heated pressure roller 208 and out of the system 200 to prevent cooling of the heated pressure roller 208.

In some examples, the second heat barrier 212-2 can be positioned between the heated pressure roller 208 and the second media guide 202-2. For example, the second heat barrier 212-2 can be positioned between the heated roller 208-2 and the second media guide 202-2. In some examples, the second heat barrier 212-2 can prevent moisture, steam, and/or vapor from contacting the heated roller 208-2. In some examples, the second heat barrier 212-2 can be utilized to direct air 210-4 from the second side of the second media guide 202-2 away from the heated pressure roller 208 (e.g., heated roller 208-2, etc.), such that the moisture, steam, and/or vapor within the air 210-4 is directed away from the heated pressure roller 208 and out of the system 200 to prevent cooling of the heated pressure roller 208.

In some examples, the plurality of apertures 204-1, 204-2 of the first media guide 202-1 and the plurality of apertures 204-3, 204-4 can comprise a particular angle to direct air from a first portion of the partially dried inkjet media 206 to a second portion of the partially dried inkjet media 206. As illustrated in FIG. 2, the first media guide 202-1 can include a first portion of the plurality of apertures 204-1 within a second quadrant (e.g., quadrant B) that include an angled aperture. In some examples, the angled apertures can direct air from the second quadrant (e.g., quadrant B) to a first quadrant (e.g., quadrant A) as described herein. In some examples, the angled apertures within the first quadrant can be in a first direction and the angled apertures within the second quadrant can be a second direction. In some examples, the angled apertures within the first quadrant can be directed to a pivot point 205-1 in a first direction and the angled apertures within the second quadrant can be directed to the pivot point 205-1 in a second direction.

As illustrated in FIG. 2, the second media guide 202-2 can include a first portion of the plurality of apertures 204-3 within a fourth quadrant (e.g., quadrant D) that include an angled aperture. In some examples, the angled apertures can direct air from the fourth quadrant (e.g., quadrant D) to a third quadrant (e.g., quadrant C) as described herein. In some examples, the angled apertures within the fourth quadrant can be in a second direction and the angled apertures within the third quadrant can be a first direction. In some examples, the angled apertures within the fourth quadrant can be directed to a pivot point 205-2 in a second direction and the angled apertures within the third quadrant can be directed to the pivot point 205-2 in a first direction. In some examples, the angle of the apertures within the second quadrant and the third quadrant can be the same angle and the angle of the apertures within the first quadrant and the fourth quadrant can be the same angle.

The system 200 can be utilized remove moisture, steam, and/or vapor from the output of the heated pressure roller 208, prevent condensation from occurring as a result of increased evaporation of the printing fluid on the partially dried inkjet media 206, and/or accelerate drying of the partially dried inkjet media 206. In some examples, the system 200 can remove the moisture, steam, and/or vapor from a print engine to prevent the moisture, steam, and/or vapor from damaging components within the print engine.

Figure 3:
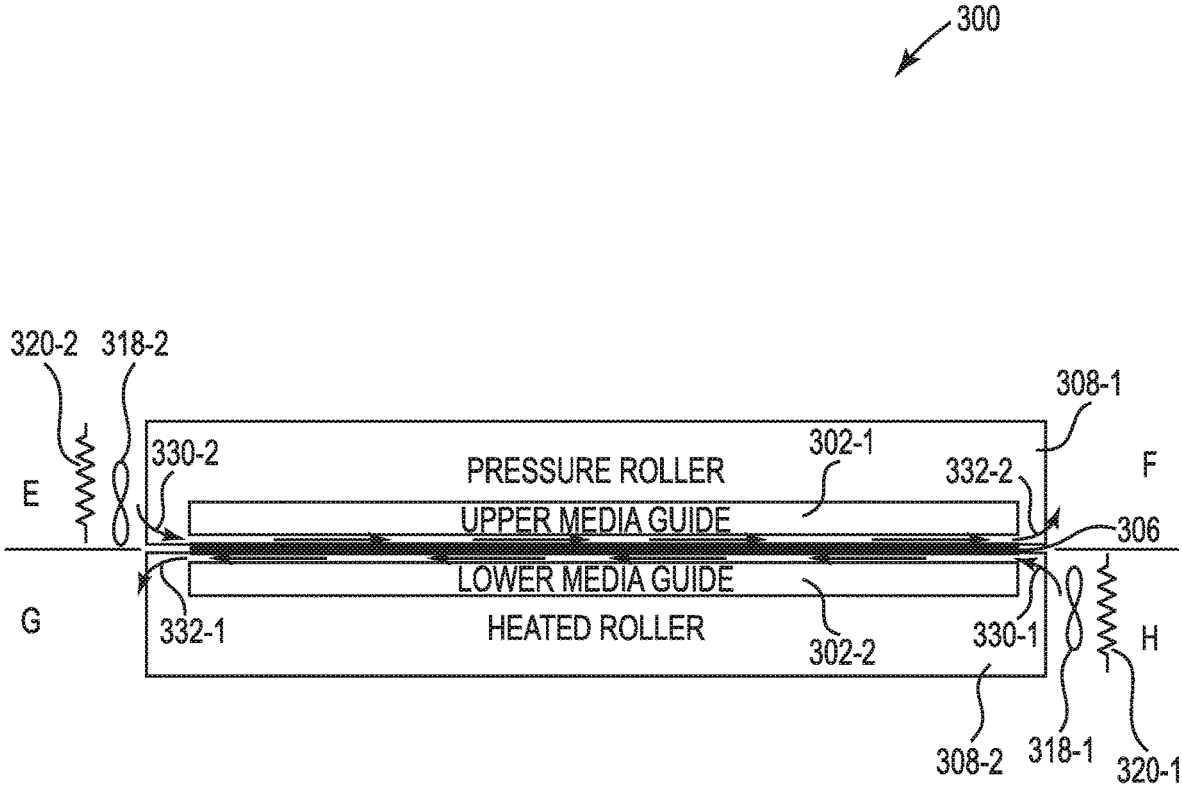
FIG. 3 illustrates an example system for a vapor manager consistent with the present disclosure.

FIG. 3 illustrates an example system 300 for a vapor manager consistent with the present disclosure. In some examples, system 300 can illustrate the system 300 from an output of a heated pressure roller comprising a pressure roller 308-1 and a heated roller 308-2. As described herein, the heated pressure roller can be a heated pressure roller that can increase evaporation of printing fluid applied to partially dried inkjet media 306. In some examples, the output of the heated pressure roller can be coupled to a number of media guides (e.g., first media guide 302-1, second media guide 302-2, etc.).

As described herein, the first media guide 302-1 can receive the partially dried inkjet media 306 on a first side (e.g., illustrated as a top side in FIG. 3, etc.) and the second media guide 302-2 can receive the partially dried inkjet media on a second side (e.g., illustrated as a bottom side in FIG. 3, etc.). In some examples, the first media guide 302-1 and the second media guide 302-2 can include a plurality of rib structures that are positioned to be in contact with the partially dried inkjet media 306. In some examples, the plurality of rib structures can create space between a tip of the rib structure and a base of the rib structure coupled to the media guide.

In some examples, the plurality of rib structures can create a space or air pathway on each side of the partially dried inkjet media 306 (e.g., top side as illustrated in FIG. 3, bottom side as illustrated in FIG. 3, etc.). In some examples, the air pathway created by the plurality of rib structures can be coupled to a fan (e.g., fan 318-1, fan 318-2, etc.). For example, a fan 318-1 can be coupled to a first edge within a fourth quadrant (e.g., quadrant H) of an air pathway between media guide 302-2 and the partially dried inkjet media 306. In this example, the fan 318-1 can provide air 330-1 through the air pathway and push air 332-1 out of the air pathway. In some examples, a first duct can be utilized to couple the fan 318-1 to the first edge between the partially dried inkjet media 306 and the media guide 302-2.

In another example, a fan 318-2 can be coupled to a second edge within a first quadrant (e.g., quadrant E) of an air pathway between media guide 302-1 and the partially dried inkjet media 306. In this example, the fan 318-2 can provide air 330-2 through the air pathway and push air 332-2 out of the air pathway. In some examples, a second duct can be utilized to couple the fan 318-2 to the second edge between the partially dried inkjet media 306 and the media guide 302-1.

In some examples, the system 300 can include a first heat source 320-1 coupled to a first fan 318-1 and a second heat source 320-2 coupled to a second fan 318-2. In some examples, the first fan 318-1 can provide air pressure to provide (e.g., force, etc.) heated air 330-1 from the first heat source 320-1 across the partially dried inkjet media 306 and out as air 332-1. In some examples, the air 332-1 can include moisture, steam, and/or vapor generated by a heated pressure roller as described herein. In some examples, the second fan 318-2 can provide air pressure to provide heated air 330-2 from the heat source 320-1 across the partially dried inkjet media 306 and out as air 332-2. In some examples, the air 332-2 can include moisture, steam, and/or vapor generated by a heated pressure roller as described herein.

In other examples, the first fan 318-1 can provide a vacuum to reverse the direction of air 332-1, such that the air 332-1 flows from a third quadrant (e.g., quadrant G) to a fourth quadrant (e.g., quadrant H). In another example, the second fan 318-2 can provide a vacuum to reverse the direction of air 332-2, such that the air 332-2 flows from a second quadrant (e.g., quadrant F) to a first quadrant (e.g., quadrant E).

Figure 4:
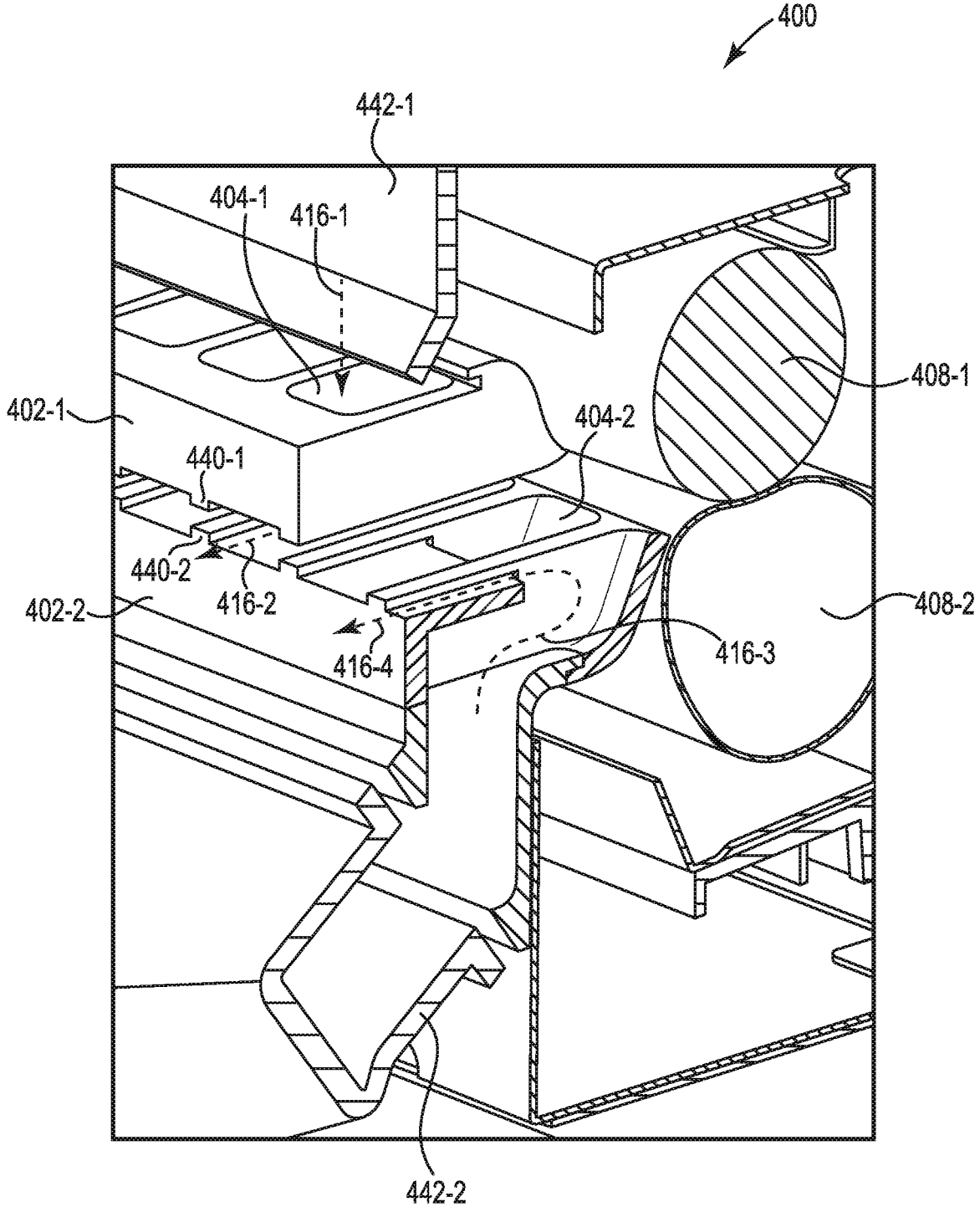
FIG. 4 illustrates an example system for a vapor manager consistent with the present disclosure.

FIG. 4 illustrates an example system 400 for a vapor manager consistent with the present disclosure. In some examples, the system 400 can include a first media guide 402-1 that includes a plurality of apertures 404-1. In some examples, the plurality of apertures 404-1 can allow air to pass through a plurality of rib structures 440-1. As described herein, the first media guide 402-1 can be coupled to an output of a heated pressure roller 408 that includes a pressure roller 408-1 and a heated roller 408-2.

In some examples, the system 400 can include a first duct 442-1 to direct air 416-1 into the plurality of apertures 404-1. In some examples, the air 416-1 can pass through the first media guide 402-1 and the air 416-2 can pass out through the plurality of rib structures 440-1. In some examples, the air 416-2 can pass over partially dried inkjet media passing between the plurality of rib structures 440-1 of the first media guide 402-1 and the plurality of rib structures 440-2 of the second media guide 402-2. In some examples, the air 416-2 can be utilized to remove moisture, steam, and/or vapor from a first side of the partially dried inkjet media. As described herein, the air 416-1 can be forced into the plurality of apertures 404-1 utilizing a fan as described herein. In some examples, the fan can also be utilized to create a vacuum to force air 416-2 into the plurality of rib structures 440-1 and force air 416-1 out of the plurality of apertures 404-1 as described herein.

In some examples, the system 400 can include a second duct 442-2 to direct air 416-3 through a plurality of apertures 404-2 of the second media guide 402-2. In some examples, the air 416-3 can be directed through the plurality of apertures 404-2 and the air 416-4 can pass out through the plurality of rib structures 440-2. In some examples, the air 416-4 can pass over partially dried inkjet media passing between the plurality of rib structures 440-1 of the first media guide 402-1 and the plurality of rib structures 440-2 of the second media guide 402-2. In some examples, the air 416-4 can be utilized to remove moisture, steam, and/or vapor from a second side of the partially dried inkjet media. As described herein, the air 416-3 can be forced into the plurality of apertures 404-2 utilizing a fan as described herein. In some examples, the fan can also be utilized to create a vacuum to force air 416-4 into the plurality of rib structures 440-2 and force air 416-3 out of the plurality of apertures 404-2 as described herein.

In some examples, the air 416-1 can pass through the plurality of apertures 404-1 and a portion of the air 416-1 can be directed toward the heated pressure roller 408. In some examples the portion of the air 416-1 can remove moisture, steam, and/or vapor from the heated pressure roller 408. In some examples, the air 416-3 can pass through the plurality of apertures 404-2 and a portion of the air 416-3 can be directed toward the heated pressure roller 408. In some examples the portion of the air 416-3 can remove moisture, steam, and/or vapor from the heated pressure roller 408.

The system 400 can be utilized remove moisture, steam, and/or vapor from the output of the heated pressure roller 408, prevent condensation from occurring as a result of increased evaporation of the printing fluid on the partially dried inkjet media, and/or accelerate drying of the partially dried inkjet media passing between the plurality of rib structures 440-1, 440-2. In some examples, the system 400 can remove the moisture, steam, and/or vapor from a print engine to prevent the moisture, steam, and/or vapor from damaging components within the print engine.

Figure 5:
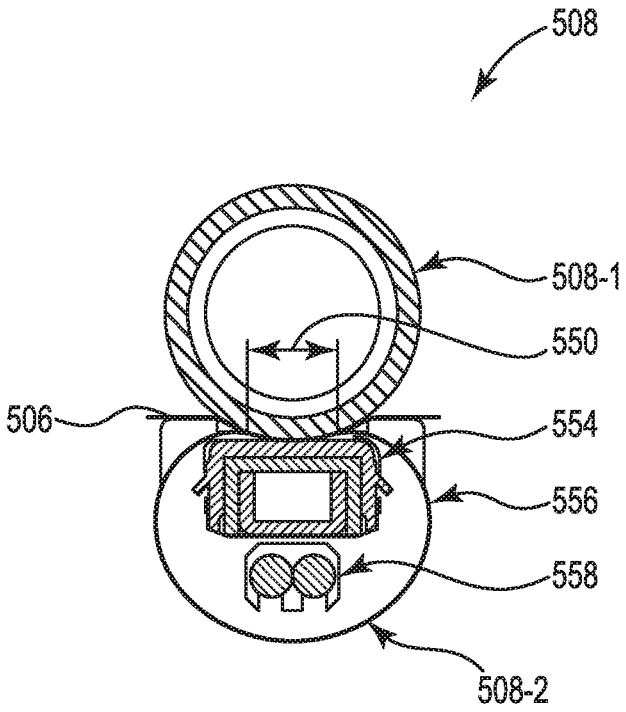
FIG. 5 illustrates an example system for a heated pressure roller consistent with the present disclosure.

FIG. 5 illustrates an example system 508 for a heated pressure roller consistent with the present disclosure. In some examples, the system 508 can be utilized as component of a conditioner for partially dried inkjet media 506. In some examples, the system 508 can apply pressure on a first side of the partially dried inkjet media 506 and apply heat on a second side of the partially dried inkjet media 506. In some examples, the system 508 can increase drying and/or evaporation of printing fluid applied to the partially dried inkjet media 506.

In some examples, the system 508 can receive partially dried inkjet media 506 at an input of the system 508 (e.g., illustrated as left side as referenced in FIG. 5). In some examples, the system 508 can include a pressure roller 508-1 to apply pressure on a first side of the partially dried inkjet media 506 (e.g., illustrated as top side as referenced in FIG. 5). In some examples, the pressure roller 508-1 can include a contact zone 550. The contact zone 550 can be an area on the pressure roller 508-1 that interacts with the first side of the partially dried inkjet media 506. In some examples, the contact zone 550 can correspond to a pressure platen 554 positioned within a heated roller 508-2.

In some examples, the heated roller 508-2 can apply heat to a second side of the partially dried inkjet media 506 (e.g., illustrated as bottom side as referenced in FIG. 5). In some examples, the heated roller 508-2 can include a heat source 558. In some examples, the heat source 558 can include a halogen heat source. In some examples, the heat source 558 can generate heat that is transferred to a heat transfer belt 556. In some examples, the heat transfer belt 556 can rotate around the heated roller 508-2 and contact the second side of the partially dried inkjet media 506 within the pressure platen 554.

The above specification, examples and data provide a description of the method and applications, and use of the system and method of the present disclosure. Since many examples can be made without departing from the spirit and scope of the system and method of the present disclosure, this specification merely sets forth some of the many possible example configurations and implementations.

What is claimed:

1. A vapor manager, comprising:

a media guide to receive partially dried inkjet media from a heated pressure roller; and a plurality of apertures through the media guide including a first portion of apertures with a first angle to direct air on to a first portion of a first side of the partially dried inkjet media and a second portion of apertures with a second angle to direct the air away from a second portion of the first side of the partially dried inkjet media.

2. The vapor manager of claim 1, wherein the plurality of apertures direct air and vapor generated by the heated pressure roller away from the second portion of the partially dried inkjet media.

3. The vapor manager of claim 2, wherein the heated pressure roller generates the vapor by evaporating printing fluid from the partially dried inkjet media.

4. The vapor manager of claim 1, comprising a fan to force air through the first portion of apertures of the media guide and remove air and vapor through the second portion of apertures of the media guide.

5. The vapor manager of claim 1, wherein the media guide comprises a plurality of rib structures to separate the partially dried inkjet media from the plurality of apertures.

6. A system for a vapor manager for partially dried inkjet media from a heated pressure roller, comprising:

a first media guide positioned on a first side of a media pathway to receive partially dried inkjet media from a heated pressure roller, wherein the first media guide comprises a plurality of apertures including a first portion of apertures with a first angle to direct air on the first side of the media pathway and a second portion of apertures with a second angle to direct the air away from the first side of the media pathway; and a second media guide positioned on a second side of the media pathway to receive the partially dried inkjet media from the heated pressure roller, wherein the second media guide comprises a plurality of apertures including a third portion of apertures with a third angle to direct air on the second side of the media pathway and a fourth portion of apertures with a fourth angle to direct the air away from the second side of the media pathway.

7. The system of claim 6, comprising:

a first thermal barrier between the heated pressure roller and the first media guide positioned on the first side of the media pathway to direct air away from the heated pressure roller; and a second thermal barrier between the heated pressure roller and the second media guide positioned on the second side of the media pathway to direct air away from the heated pressure roller.

8. The system of claim 6, comprising a first fan on the first side of the media pathway to force air through the first media guide and a second fan on the second side of the media pathway to force air through the second media guide.

9. The system of claim 8, wherein the first fan can provide air pressure to the first media guide in a first mode and provide a vacuum to the first media guide in a second mode.

10. A system for a vapor manager for partially dried inkjet media from a heated pressure roller, comprising:

a heated pressure roller to receive partially dried inkjet media at an input and provide the partially dried inkjet media to media pathway at an output;

a first media guide coupled to the output positioned on a first side of the media pathway to receive the partially dried inkjet media from the heated pressure roller, wherein the first media guide includes a first portion of apertures with a first angle and a second portion of apertures with a second angle;

a first fan coupled to a first edge of the first media guide to:

force air in to the first portion of apertures between the partially dried inkjet media and the first media guide; and force the air out of the second portion of the apertures between the partially dried inkjet media and the first media guide;

a second media guide positioned on a second side of the media pathway to receive the partially dried inkjet media from the heated pressure roller, wherein the second media guide includes a third portion of apertures with a third angle and a fourth portion of apertures with a fourth angle; and a second fan coupled to a second edge of the second media guide to:

force air in to the third portion of apertures between the partially dried inkjet media and the second media guide; and force the air out of the fourth portion of the apertures between the partially dried inkjet media and the second media guide.

11. The system of claim 10, wherein the first fan is coupled to a first heat source and the second fan is coupled to a second heat source.

12. The system of claim 10, wherein the first portion of apertures include a plurality of rib structures coupled to the first media guide and the second portion of apertures include a plurality of rib structures coupled to the second media guide.

13. The system of claim 10, comprising:

a first duct to couple the first fan to the first edge between the partially dried inkjet media and the first media guide; and a second duct to couple the second fan to the second edge between the partially dried inkjet media and the second media guide.

* * * * *